US008450038B2

(12) United States Patent
Shibai et al.

(10) Patent No.: US 8,450,038 B2
(45) Date of Patent: May 28, 2013

(54) TONER

(75) Inventors: Yasuhiro Shibai, Osaka (JP); Satoru Ariyoshi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 295 days.

(21) Appl. No.: 12/958,550

(22) Filed: Dec. 2, 2010

(65) Prior Publication Data

US 2011/0136055 A1 Jun. 9, 2011

(30) Foreign Application Priority Data

Dec. 8, 2009 (JP) ..... P2009-278987

(51) Int. Cl.
*G03G 9/087* (2006.01)

(52) U.S. Cl.
USPC ..... 430/108.8; 430/109.3

(58) Field of Classification Search
USPC ..... 430/109.2, 109.3, 108.8
See application file for complete search history.

(56) References Cited

U.S. PATENT DOCUMENTS

2010/0291481 A1* 11/2010 Yamada et al. ..... 430/108.2

FOREIGN PATENT DOCUMENTS

| | | |
|---|---|---|
| JP | 08-328304 | 12/1996 |
| JP | 2006-292820 | 10/2006 |
| JP | 2008-020631 | 1/2008 |
| JP | 2008-281883 | 11/2008 |

* cited by examiner

*Primary Examiner* — Janis L Dote
(74) *Attorney, Agent, or Firm* — Nixon & Vanderhye, P.C.

(57) ABSTRACT

A toner having good dispersibility of a pigment and a release agent therein and having excellent low temperature fixability is provided. The toner includes a binder resin, a pigment and a release agent, and the binder resin includes a graft polymer in which abietic acids and an unsaturated fatty acid are grafted to a vinyl resin. An image is formed using such a toner.

6 Claims, 1 Drawing Sheet

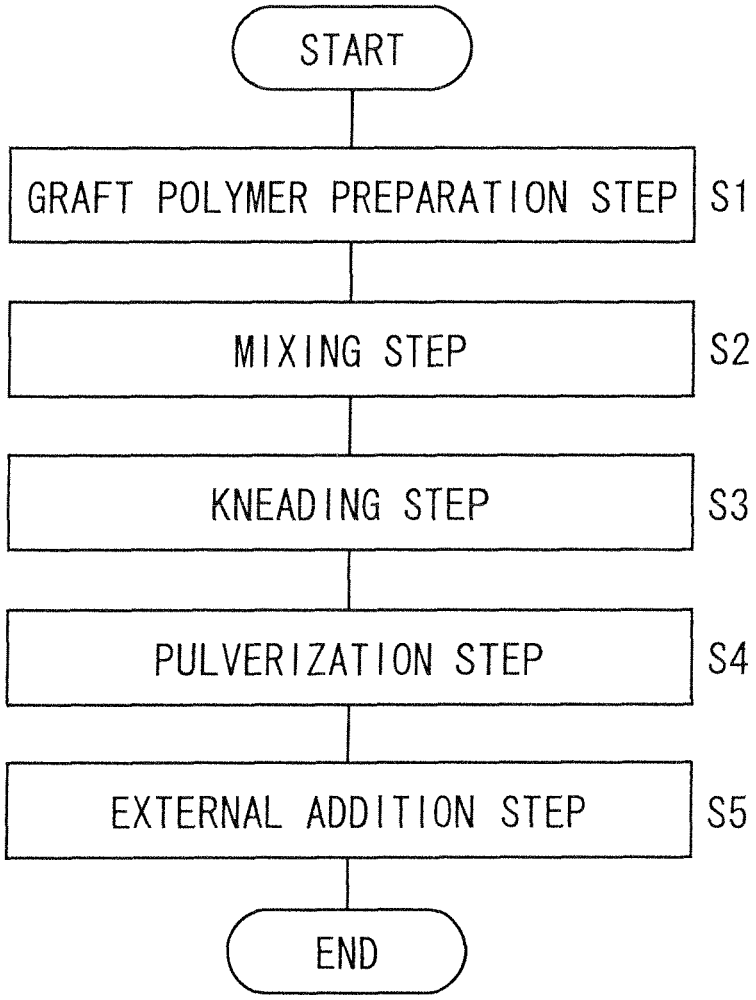
START
GRAFT POLYMER PREPARATION STEP
S1
MIXING STEP
S2
KNEADING STEP
S3
PULVERIZATION STEP
S4
EXTERNAL ADDITION STEP
S5
END

TONER

CROSS-REFERENCE TO RELATED APPLICATION

This application claims priority to Japanese Patent Application No. 2009-278987, which was filed on Dec. 8, 2009, the contents of which are incorporated herein by reference in its entirety.

BACKGROUND OF THE INVENTION

1. Field of the Invention

The present invention relates to a toner that can suitably be used in an image forming apparatus of an electrophotographic system.

2. Description of the Related Art

In an image forming apparatus utilizing an electrophotographic system, an image is formed by passing through, for examples, a charging step, an exposure step, a development step, a transfer step, a cleaning step, a charge removing step and a fixing step. A surface of a photoreceptor rotatably driven is uniformly charged by a charging apparatus in the charging step, and the charged surface of the photoreceptor is irradiated with laser light by an exposure apparatus in the exposure step.

Thus, an electrostatic latent image is formed on the surface of the photoreceptor. The electrostatic latent image on the surface of the photoreceptor is developed using a developer by a developing device in the development step, whereby a toner image is formed on the surface of the photoreceptor, and the toner image on the surface of the photoreceptor is transferred to a transfer material by a transfer apparatus in the transfer step.

The toner image is then heated by a fixing apparatus in the fixing step, whereby the toner image is fixed to the transfer material. A transfer residual toner remaining on the surface of the photoreceptor after image formation operation is removed by a cleaning apparatus in the cleaning step, and recovered in a given recovery part. Residual charges on the surface of the photoreceptor after cleaning are removed by a charge removing apparatus in the charge removing step for the next image formation.

Examples of the developer which develops an electrostatic latent image on a surface of a photoreceptor include one-component developers consisting of a toner and two-component developers comprising a toner and a carrier.

For example, in Japanese Unexamined Patent Publication JP-A 2006-292820 is disclosed a toner containing a resin comprising an epoxy resin having grafted thereto a rosin, and a binder resin in order to realize low temperature fixing that can achieve energy saving in such an image forming apparatus.

Furthermore, in JP-A 2008-20631 is disclosed a toner containing a polyester resin containing a purified rosin, and a graft polymer comprising a polyolefin resin having grafted thereto a vinyl resin comprising styrene or an acryl monomer.

However, the toner disclosed in JP-A 2006-292820 does not contain a flexible component in a resin, and therefore has the problem that dispersibility of a release agent is decreased. Where the dispersibility of a release agent is decreased, the release agent is liable to be exposed on a surface of toner particles, and toner particles are liable to become massed together at high temperature.

The toner disclosed in JP-A 2008-20631 is that dispersibility of a pigment and a release agent can be improved by containing a graft copolymer in a resin.

However, reactivity between a polyolefin resin and a vinyl resin is low. Therefore, a sufficient amount of the graft polymer cannot be contained in the toner, resulting in insufficient dispersibility of the pigment and the release agent in the toner. As a result, there are the problems that color reproducibility is decreased, and toner particles are liable to become massed together at high temperature.

SUMMARY OF THE INVENTION

An object of the invention is to provide a toner having good dispersibility of a pigment and a release agent therein and excellent low temperature fixability.

The invention provides a toner comprising a binder resin, a pigment and a release agent, the binder resin comprising a graft polymer in which abietic acids and an unsaturated fatty acid are grafted to a vinyl resin.

According to the invention, the toner comprises a binder resin, a pigment and a release agent, and the binder resin comprises a graft polymer in which abietic acids and an unsaturated fatty acid are grafted to a vinyl resin. When the binder resin comprises a graft polymer in which abietic acids and an unsaturated fatty acid are grafted to a vinyl resin, dispersibility of the pigment in the toner is improved by abietic acids having a rigid planar structure, and dispersibility of the release agent in the toner is improved by a flexible unsaturated fatty acid. Those improvements can make dispersibility of the pigment and the release agent good, and can form a toner having excellent color reproducibility and toner durability. The graft polymer in which abietic acids and an unsaturated fatty acid are grafted to a vinyl resin has an appropriate molecular weight, and therefore can form a toner having excellent low temperature fixability.

Further in the invention, it is preferable that the vinyl resin comprises a monomer unit comprising an acrylate monomer having a glycidyl group.

According to the invention, the vinyl resin comprises a monomer unit comprising an acrylate monomer having a glycidyl group. When the vinyl resin comprises a monomer unit comprising an acrylate monomer having a glycidyl group, the abietic acids and the unsaturated fatty acid can be grafted to the vinyl resin at relatively low temperature, and a molecular weight of the graft polymer obtained can easily be adjusted.

Further in the invention, it is preferable that the abietic acids are abietic acids contained in a purified rosin, a hydrogenated rosin or a disproportionated rosin.

According to the invention, the abietic acids are abietic acids contained in a purified rosin, a hydrogenated rosin or a disproportionated rosin. Use of the abietic acids improves heat resistance and light resistance, and therefore can prevent coloration of a resin due to thermal deterioration at the time of the production of a toner.

Further in the invention, it is preferable that the graft polymer is intermolecularly crosslinked.

According to the invention, the graft polymer is intermolecularly crosslinked. This makes it possible to prevent a viscosity of a toner from decreasing at high temperature at the time of fixing. As a result, wider fixing non-offset range can be obtained, and offset resistance can be improved.

Further in the invention, it is preferable that the release agent is a synthetic hydrocarbon wax.

According to the invention, the release agent is a synthetic hydrocarbon wax. The synthetic hydrocarbon wax has a low content of low molecular weight components. Therefore, when the release agent is the synthetic hydrocarbon wax, generation of volatile organic compounds can be prevented.

Furthermore, the synthetic hydrocarbon wax has high releasability, and therefore can prevent adhesion to a member such as fixing rollers.

Further in the invention, it is preferable that the release agent has a melting point of 80° C. or higher and 110° C. or lower.

According to the invention, the release agent has a melting point of 80° C. or higher and 110° C. or lower. This makes it possible to prevent aggregation of toner particles to each other at high temperature, to improve durability of the toner, and to achieve excellent low temperature fixability.

The invention provides a method of producing a toner comprising a binder resin, a pigment and a release agent, the method comprising:

a graft polymer preparation step of obtaining a graft polymer in which abietic acids and an unsaturated fatty acid are grafted to a vinyl resin, by mixing a vinyl resin, a purified rosin, a hydrogenated rosin or a disproportionated rosin, and an unsaturated fatty acid, and heating the resulting mixture; and a kneading step of kneading a mixture of the graft polymer, a pigment and a release agent while heating.

According to the invention, the method of producing a toner comprises a graft polymer preparation step and a kneading step. In the graft polymer preparation step, a vinyl resin, a purified rosin, a hydrogenated rosin or a disproportionated rosin, and an unsaturated fatty acid are mixed and heated, thereby obtaining a graft polymer in which abietic acids and the unsaturated fatty acid are grafted to a vinyl resin. In the kneading step, a mixture of the graft polymer, a pigment and a release agent are kneaded while heating. Thereby a toner can be obtained that comprises a binder resin including a graft polymer in which abietic acids and the unsaturated fatty acid are grafted to a vinyl resin.

Further in the invention, it is preferable that in the kneading step, a polybasic acid is added to the mixture, and the resulting mixture is kneaded while heating, whereby the graft polymer is intermolecularly crosslinked.

According to the invention, in the kneading step, a polybasic acid is added to the mixture, and the resulting mixture is kneaded while heating, whereby the graft polymer is intermolecularly crosslinked. Where intermolecular crosslinking of the vinyl resin is conducted before grafting the abietic acids and the unsaturated fatty acid on the vinyl resin, the abietic acids and the unsaturated fatty acid are not sufficiently grafted to the vinyl resin, and dispersibility of the pigment and the release agent is decreased. When the graft polymer is intermolecularly crosslinked in the kneading step, a toner having a wide fixing non-offset range can be formed, while maintaining good dispersibility of the pigment and the release agent.

BRIEF DESCRIPTION OF THE DRAWINGS

Other and further objects, features, and advantages of the invention will be more explicit from the following detailed description taken with reference to the drawings wherein:

FIG. 1 is a flowchart showing an example of a procedure for a method of producing a toner according to an embodiment of the invention.

DETAILED DESCRIPTION

1. Toner

The toner according to an embodiment of the invention comprises a binder resin, a pigment and a release agent. The binder resin includes a graft polymer in which abietic acids and an unsaturated fatty acid are grafted to a vinyl resin.

<Binder Resin>

(Graft Polymer)

Examples of the vinyl resin constituting the graft polymer include a polymer of a styrene monomer and a (meth)acrylate monomer or other monomer. Examples of the styrene monomer include styrene and a styrene substitute. Examples of the styrene and styrene substitute include styrene and an alkyl styrene (for example, α-methylstyrene and p-methylstyrene). Among them, styrene is preferred.

Examples of the (meth)acrylate monomer include alkyl esters having 1 to 18 carbon atoms, such as methyl (meth) acrylate, ethyl (meth)acrylate, butyl (meth)acrylate, 2-ethylhexyl (meth)acrylate, lauryl (meth)acrylate and stearyl (meth)acrylate; hydroxyl group-containing (meth)acrylates such as hydroxyethyl (meth)acrylate; amino group-containing (meth)acrylates such as dimethylaminoethyl (meth)acrylate and diethylaminoethyl (meth)acrylate; nitrile group-containing (meth)acryl compounds such as acrylonitrile; and glycidyl group-containing (meth)acrylic compounds such as (meth)acrylic acid glycidyl methacrylate.

Among them, methyl (meth)acrylate, ethyl (meth)acrylate, butyl (meth)acrylate, 2-ethylhexyl (meth)acrylate, (meth) acrylic acid, glycidyl group-containing (meth)acryl compounds and mixtures of at least two of them are preferred. Examples of the glycidyl group-containing (meth)acryl compound include glycidyl methacrylate, and the glycidyl methacrylate is more preferred.

Examples of the other monomer other than the styrene monomer and the (meth)acrylate monomer include a vinyl ester, an aromatic vinyl monomer and an aliphatic hydrocarbon vinyl monomer. Examples of the vinyl ester include vinyl acetate and vinyl propionate. Examples of the aromatic vinyl monomer include vinyibenzene and divinylbenzene. Examples of the aliphatic hydrocarbon vinyl monomer include normal butyl acrylate and butadiene.

In the embodiment, examples of the abietic acids to be grafted to the vinyl resin include abietic acid, dihydroabietic acid, tetrahydroabietic acid and dehydroabietic acid. The abietic acids are abietic acids contained in a purified rosin, a hydrogenated rosin or a disproportionated rosin. A purified rosin, a hydrogenated rosin and a disproportionated rosin are hereinafter collectively referred to as a "rosin".

The purified rosin is a natural resin obtained by distillation purifying a pine resin which is a sap of a pinaceous plant, and is a mixture containing abietic acid as a main component and further containing a resin acid such as pimaric acid and dehydroabietic acid.

The hydrogenated rosin is a rosin obtained by adding hydrogen to the purified rosin containing abietic acid as a main component in the presence of a catalyst, and includes dihydroabietic acid and tetrahydroabietic acid. The disproportionated rosin is a rosin obtained by heating a purified rosin containing abietic acid as a main component at medium temperature or reacting the purified rosin at high temperature in the presence of an acid catalyst and saponifying the reaction product, and includes dehydroabietic acid, dihydroabietic acid and tetrahydroabietic acid. When the abietic acids are abietic acids contained in a purified rosin, a hydrogenated rosin or a disproportionated rosin, heat resistance and light resistance are improved. As a result, coloration due to thermal deterioration of a resin can be prevented at the time of kneading toner raw materials in a production method of a toner described below.

The rosin has a softening temperature of preferably from 50° C. to 100° C., more preferably from 60° C. to 90° C., and further preferably from 65° C. to 85° C. The softening temperature of a rosin means a softening temperature measured when a rosin is once melted and the melt is spontaneously cooled under the environment of a temperature of 25° C. and a relative humidity of 50% for 1 hour.

The rosin has an acid value of preferably from 100 to 200 mgKOH/g, more preferably from 130 to 180 mgKOH/g, and further preferably from 150 to 170 mgKOH/g.

Examples of the unsaturated fatty acid to be grafted to the vinyl resin include myristoleic acid, palmitoleic acid, oleic acid, linoleic acid, linolenic acid and ricinoleic acid. A dry oil or a semidrying oil fatty acid having a non-conjugated double bond, such as linseed oil fatty acid, sunflower oil fatty acid, soybean oil fatty acid, rice bran oil fatty acid, sesame oil fatty acid, castor oil fatty acid, dehydrated castor oil fatty acid, perilla oil fatty acid, hemp seed oil fatty acid, cotton seed oil fatty acid or tall oil fatty acid can be used.

Those dry oil or semidrying oil fatty acids include unsaturated fatty acids such as oleic acid, linoleic acid, linolenic acid, eleostearic acid and ricinoleic acid. Higher fatty acids in which a fatty acid group has an average number of carbon atoms of from 12 to 22 are preferred.

The graft polymer obtained by grafting the abietic acids and the unsaturated fatty acid to the vinyl resin has a weight average molecular weight (Mw) of preferably 3,000 or more and 90,000 or less, more preferably 5,000 or more and 35,000 or less, and further preferably 7,000 or more and 25,000 or less. Where the weight average molecular weight (Mw) is less than 3,000, stability of a steric structure of the graft polymer is decreased, dispersibility of the pigment is decreased, and durability of an image after fixing is decreased. Furthermore, where the weight average molecular weight (Mw) of the graft polymer is less than 3,000, the graft polymer must be used together with other resin in order to obtain a wide fixing non-offset range. Where the weight average molecular weight (Mw) exceeds 90,000, aggregation of pigments attached to abietic acids occurs, and dispersibility of the pigment in a toner may be decreased.

The graft polymer has a number average molecular weight (Mn) of preferably 2,000 or more and 20,000 or less.

The graft polymer has a softening temperature of preferably from 90° C. to 150° C., and more preferably from 100° C. to 120° C. The vinyl resin has a glass transition temperature (Tg) of preferably from 40° C. to 80° C., and more preferably from 50° C. to 70° C. Where the glass transition temperature (Tg) is lower than 40° C., storage stability of a toner is decreased. Where the glass transition temperature (Tg) exceeds 80° C., the lower limit temperature of fixing is increased, resulting in deterioration of low temperature fixability.

The graft polymer is preferably intermolecularly crosslinked in the toner. This makes it possible to prevent the viscosity of a toner at high temperature from decreasing. As a result, a wider fixing non-offset range can be obtained, and offset resistance can be improved.

When the graft polymer synthesized from a vinyl resin containing a glycidyl group-containing (meth)acryl monomer as a monomer unit is intermolecularly crosslinked, the graft polymer has an epoxy equivalent of preferably 500 or more and 2,000 or less. This embodiment enables the graft polymer to sufficiently intermolecularly crosslink in a toner.

As described above, the toner of the embodiment comprises the graft polymer in which abietic acids and an unsaturated fatty acid are grafted to a vinyl resin, as the binder resin.

A vinyl resin obtained by copolymerizing styrene or acrylic acid ester has very broad degree of freedom of design, such as introduction of a polar group and a crosslinking component, and is therefore a resin having been widely used as a binder resin for a toner. However, the vinyl resin is that the main chain is a single bond of C—C bond, and therefore had the problems that the resin is generally brittle, and durability of an image after fixing is poor. Durability of an image after fixing can be supplemented by increasing a molecular weight of the vinyl resin or introducing a crosslinking component into the vinyl resin. However, dispersibility of a pigment and a release agent in a toner is decreased as the molecular weight is increased and the amount of the crosslinking agent introduced is increased. Where dispersibility of the pigment in a toner is low, color reproducibility is decreased. Where dispersibility of the release agent in a toner is low, the release agent is liable to be exposed on the surface of toner particles. As a result, toner particles become massed together at high temperature, resulting in decrease in durability of a toner.

On the other hand, when abietic acids and an unsaturated fatty acid are grafted to the vinyl resin, a graft polymer having an appropriate molecular weight as described before can be obtained. Therefore, when the binder resin comprises the graft polymer, durability of an image after fixing can be made good. In addition to this, dispersibility of a release agent and a pigment in a toner, particularly dispersibility of a pigment in a toner, is improved by the abietic acids having a rigid planar structure, and dispersibility of a release agent in a toner is improved by a flexible unsaturated fatty acid, thereby enabling dispersibility of the pigment and the release agent to be good. As a result, a toner having excellent color reproducibility and durability can be obtained. The unsaturated fatty acid has high hydrophobicity and can improve wettability of a pigment in kneading at the time of the production of a toner described below. Therefore, the unsaturated fatty acid can improve dispersibility of the pigment. However, in the case that only the unsaturated fatty acid is grafted to the vinyl resin, dispersibility of a pigment is insufficient.

In the polymer obtained by grafting only the abietic acids on the vinyl resin, its molecular weight is insufficient. Therefore, low temperature fixability can be improved, but a wide fixing non-offset range cannot be obtained. When the graft polymer in which the abietic acids and the unsaturated fatty acid are grafted to a vinyl resin is used, a toner having excellent low temperature fixability and wide fixing non-offset range can be formed.

Rosin and unsaturated fatty acid are natural materials. Therefore, when the abietic acids contained in a rosin and the unsaturated fatty acid are used as toner raw materials, carbon dioxide emissions can be reduced than the case of using raw materials derived from petroleum.

The graft polymer has an appropriate molecular weight as described above. Therefore, the graft polymer alone can be used as a binder resin, but the graft polymer may be used together with other resin. The other resin is not particularly limited so long as the resin is a thermoplastic resin. Examples of the other resin include compounds with styrenes such as styrene, para-chlorostyrene and α-methylstyrene, acryl monomers such as methyl acrylate, ethyl acrylate, n-propyl acrylate, lauryl acrylate and 2-ethylhexyl acrylate, methacryl monomers such as methyl methacrylate, ethyl methacrylate, n-propyl methacrylate, lauryl methacrylate and 2-ethylhexyl methacrylate, ethylenically unsaturated acid monomers such as acrylic acid, methacrylic acid and sodium styrenesulfonate, vinyl nitriles such as acrylonitrile and methacrylonitrile, vinyl ethers such as vinyl methyl ether and vinyl isobutyl ether, and vinyl ketones such as vinyl methyl ketone, vinyl ethyl ketone and vinyl isopropenyl ketone; polyester resins; and polyurethane resins.

<Pigment>

The pigment can use various kinds and various colors of pigments, regardless of organic pigments and inorganic pigments.

Examples of a yellow pigment include colorants such as chrome yellow, zinc yellow, cadmium yellow, yellow iron oxide, mineral fast yellow, nickel titanium yellow, nable yellow, napththol yellow S, hansa yellow G, hansa yellow 10G, benzidine yellow G, benzidine yellow GR, quinoline yellow lake, permanent yellow NCG and tartrazine lake.

Examples of an orange pigment include colorants such as red chrome yellow, molybdenum orange, permanent orange GTR, pyrazolone orange, vulcan orange, induslene brilliant orange, RK benzidine orange G and induslene brilliant orange GK.

Examples of a red pigment include colorants such as quinacridone, red iron oxide, cadmium red, red lead, mercury sulfide, cadmium, permanent red 4R, lithol red, pyrazolone red, watching red, calcium salt, lake red C, lake red D, brilliant carmine 6B, eosin lake, rhodamine lake B, alizarin lake and brilliant carmine 3B.

Examples of a violet pigment include colorants such as manganese violet, fast violet B and methyl violet lake.

Examples of a blue pigment include colorants such as Russian blue, cobalt blue, alkali blue lake, Victoria blue lake, phthalocyanine blue, nonmetal phthacyanine blue, phthalocyanine partially chlorinated product, fast sky blue and induslene blue BC.

Examples of a green pigment include colorants such as chrome green, chrome oxide, pigment green B, malachite green lake and final yellow green G.

Among those pigments, organic color pigments have high coloring power and are therefore preferred. Furthermore, the quinacridone pigment has high heat resistance and high color reproducibility, and is therefore preferred.

The organic pigment forms secondary particles which are an aggregate of primary particles. The secondary particles are dispersed by mechanical shearing, thereby developing color reproducibility. However, the secondary particles are firmly aggregated, and there is a limit to improve dispersibility in a toner by only mechanical shearing. In particular, the quinacridone pigment has poor dispersibility in a toner. On the other hand, in the embodiment, the binder resin comprises the graft polymer in which the abietic acids and the unsaturated fatty acid are grafted to a vinyl resin, and the abietic acids having a rigid planar structure and an organic pigment having an aromatic crystalline structure are easily attached to each other. This can improve dispersibility of the organic pigment.

The content of the pigment in a toner is preferably from 3 to 8% by weight, and more preferably from 4 to 6% by weight, based on the weight of the toner.

The pigment may be used in a form of a masterbatch in order to uniformly disperse in a toner. The graft polymer described before is preferably used as a resin used in preparing the masterbatch.

<Release Agent>

As the release agent, a conventional release agent can be used, and preferably a synthetic hydrocarbon wax is used. The synthetic hydrocarbon wax is that the content of low molecular weight components is low and generation of volatile organic compounds is small, and is therefore preferably used. Furthermore, the synthetic hydrocarbon wax has high releasability and less contamination of members such as fixing rollers, and is therefore preferably used.

The synthetic hydrocarbon wax has low polarity and therefore has low dispersibility in a resin. Therefore, particularly when a large amount of the synthetic hydrocarbon wax is contained in a toner to realize low temperature fixing, the synthetic hydrocarbon wax is easily exposed on the surface of the toner, and durability of the toner was decreased. However, in the embodiment, the binder resin comprises the graft polymer in which abietic acids and an unsaturated fatty acid are grafted to a vinyl resin, and the unsaturated fatty acid has low polarity, is flexible, and easily adapts to the synthetic hydrocarbon wax. Therefore, dispersibility of the synthetic hydrocarbon wax can be improved.

Example of the synthetic hydrocarbon wax include polyolefin waxes such as low molecular weight polypropylene, polyethylene, oxidized polypropylene and polyethylene, and Fischer-Tropsh wax.

The release agent has a melting point of preferably 80° C. or higher and 110° C. or lower, and more preferably 85° C. or higher and 100° C. or lower. Where the melting point of the release agent is lower than 80° C., aggregation of toner particles occurs at high temperature, and toner durability may be decreased. Where the melting point of the release agent exceeds 110° C., low temperature fixability may be decreased.

The release agent is added in an amount of preferably from 1 to 10 parts by weight based on 100 parts by weight of the binder resin. The toner of the embodiment may further comprise a magnetic powder and a charge control agent, in addition to the binder resin, the pigment and the release agent.

<Magnetic Powder>

Examples of the magnetic powder include magnetic materials such as magnetite, y-hematite and various ferrites.

<Charge Control Agent>

Examples of the charge control agent include charge control agents for negatively charged toner and charge control agents for positively charged toner.

Examples of the charge control agent for negatively charged toner include surfactants such as chromium complexes, zinc complexes, aluminum complexes and boron complexes of chromium azo complex dyes, iron azo complex dyes, cobalt azo complex dyes, salicylic acid and salicylic acid derivatives; chromium, zinc, aluminum and boron complexes of salicylic acid salt compounds, naphthol acid and naphthol acid derivatives; zinc, aluminum and boron complexes of naphthol acid salt compounds, benzyl acid and benzyl acid derivatives; benzyl acid salt compounds; long chain alkyl carboxylic acid salts; and long chain alkyl sulfonic acid salts.

Examples of the charge control agent for positively charged toner include nigrosine dyes, nigrosine dye derivatives, triphenylmethane derivatives, and derivatives of quaternary ammonium salt, quaternary phosphonium salt, quaternary pyridinium salt, guanidine salt and amidine salt.

The charge control agent is added in an amount of from 0.01 to 5 parts by weight based on 100 parts by weight of the binder resin.

<External Additive>

Various external additives may be externally added to the surface of the toner of the embodiment in order to adjust flowability of the toner, to prevent filming to a photoreceptor and to improve cleanability of residual toner on a photoreceptor drum.

Examples of the external additive include inorganic oxides such as silica, alumina, titania, zirconia, tin oxide and zinc oxide; homopolymer or copolymer resin fine particles of compounds such as acrylic acid esters, methacrylic acid esters and styrene; fluorine resin fine particles; silicone resin fine particles; higher fatty acids such as stearic acid, and metal salts of the high fatty acids; and additives such as carbon black, graphite fluoride, silicon carbide and boron nitride.

The external additives may be subjected to hydrophobization treatment with a silane coupling agent, a silicone oil or the like.

The respective external additives are added in an amount of preferably from 0.5 to 5 parts by weight based on 100 parts by weight of the toner free of external additives.

The toner has a volume average particle size of preferably 5.0 μm or more and 8.0 μm or less, and has a variation coefficient of preferably 15 or more and 25 or less.

2. Method of Producing Toner

FIG. 1 is a flowchart showing an example of a procedure for a method of producing a toner according to an embodiment of the invention. The method of producing a toner of the embodiment comprises a graft polymer preparation step S1, a mixing step S2, a kneading step S3, a pulverization step S4 and an external addition step S5.

In the graft polymer preparation step S1, a graft polymer in which abietic acids and an unsaturated fatty acid are grafted to a vinyl resin is obtained.

In the graft polymer preparation step S1, a vinyl resin is first synthesized by polymerizing monomer units of the vinyl resin described before. Polymerization reaction is generally conducted in an atmosphere of an inert gas such as nitrogen. Polymerization temperature is generally from 50° C. to 200° C., and preferably from 100° C. to 150° C. Reaction time is influenced by other conditions, but is generally from 1 to 10 hours, and preferably from 2 to 8 hours. Where the reaction time is shorter than 1 hour, it is difficult to control the reaction. The reaction time exceeding 8 hours is economically disadvantageous. When a solvent was used at the time of polymerization, desolvation treatment is conducted after the reaction.

Examples of the polymerization solvent include inert solvents such as aromatic hydrocarbons such as toluene and xylene; halides such as chloroform and ethylene dichloride, ketones such as acetone and methyl ethyl ketone, and dimethylformamide.

Synthesis of the vinyl resin requires a radically polymerizable initiator. Examples of the initiator include sulfites such as ammonium sulfite, potassium sulfite and sodium sulfite, azo compounds having trade names such as V-60, V-65, VA-601 and VA-501, manufactured by Wako Pure Chemical Industries, Ltd., and organic peroxides having trade names such as KAYAESTER O, KAYABUTYL B and LAUROX, manufactured by Kayaku Akzo Co., Ltd. Those initiators may be used each alone, or two or more of them may be used in combination as a mixture.

The initiator is added in an amount of preferably 0.1 part by weight or more and 5 parts by weight or less based on 100 parts by weight of vinyl resin raw materials. The initiator may be added in several batches in the course of the polymerization reaction.

The rosin (purified rosin, hydrogenated rosin or disproportionated rosin) and the unsaturated fatty acid are mixed with the vinyl resin thus synthesized, and the resulting mixture is heated, thereby grafting the abiestic acids and the unsaturated fatty acid by addition and condensation reactions. Thus, the graft polymer can be obtained. In this case, when the vinyl resin contains a glycidyl group-containing (meth)acryl monomer as a monomer unit, the abietic acids and the unsaturated fatty acid can be grafted to the vinyl resin at relatively low temperature. This can easily adjust the molecular weight of the graft polymer obtained.

The degree of grafting of the abietic acids and the unsaturated fatty acid to the vinyl resin can appropriately be adjusted by an acid value of the rosin and the unsaturated fatty acid. When the rosin and the unsaturated fatty acid, having the acid value of the above-described range are used, the graft polymer appropriately grafted can be obtained.

Heating temperature in grafting the abietic acids and the unsaturated fatty acid to the vinyl resin is appropriately adjusted, taking the kind of resin and the like into consideration. End point of the graft reaction is controlled by residual acid value. For example, the reaction is terminated when the residual acid value became 5 mgKOH/g or less.

The rosin is added in an amount of preferably 10 parts by weight or more and 50 parts by weight or less based on 100 parts by weight of the vinyl resin. The unsaturated fatty acid is added in an amount of preferably 5 parts by weight or more and 25 parts by weight or less based on 100 parts by weight of the vinyl resin.

When the abietic acids and the unsaturated fatty acid are grafted to the vinyl resin, a catalyst can be used to make the reaction conditions milder. Examples of the catalyst include tertiary amine compounds such as dimethyl benzylamine, and metal compounds such as dibutyltin oxide.

The catalyst is added in an amount of preferably 0.1 part by weight or more and 1.0 part by weight or less based on 100 parts by weight of the graft polymer raw materials.

In the mixing step S2, raw materials such as a binder resin, a pigment, a release agent and a charge control agent are mixed by airflow mixing machines such as HENSCHEL MIXER, SUPERMIXER, MECHANOMILL and Q-type mixer, thereby obtaining a toner mixture.

In the kneading step S3, the toner mixture is melt-kneaded at a temperature of from 120° C. to 160° C. by a melt-kneading machine such as an extruder, thereby obtaining a toner kneaded material. In the extruder, a cylinder preset temperature is preferably 100° C. or higher and 150° C. or lower, the number of revolutions of a barrel is preferably 100 rpm or more and 350 rpm or less, and raw material supply rate is preferably from 20 kg/h to 150 kg/h.

In the kneading step S3, it is preferred that a polybasic acid is mixed together with the toner mixture, followed by kneading while heating, whereby the graft polymer is intermolecularly crosslinked.

Where a large amount of the crosslinking component is present in the binder resin, the pigment and the release agent are difficult to be uniformly mixed, resulting in decrease in dispersibility. Where the vinyl resin is intermolecularly crosslinked before grafting an abietic acids and an unsaturated fatty acid to the vinyl resin, the abietic acids and the unsaturated fatty acid are not sufficiently grafted to the vinyl resin, and dispersibility of a pigment and a release agent is decreased. When the graft polymer having the abietic acidw and the unsaturated fatty acid grafted to the vinyl resin is intermolecularly crosslinked in the kneading step S3, a toner having wide fixing non-offset range can be obtained, while maintaining good dispersibility of the pigment and the release agent.

Examples of the polybasic acid include aromatic carboxylic acids such as terephthalic acid, isophthalic acid, phthalic anhydride, trimellitic anhydride, pyromellitic acid and naphthalenedicarboxylic acid; aliphatic carboxylic acids such as maleic anhydride, fumaric acid, succinic acid and alkenyl succinic anhydride; and methyl esterified products of those polybasic acids. The polybasic acids may be used each alone, or two or more of them may be used in combination.

When the graft polymer is intermolecularly crosslinked, the temperature at the time of kneading is preferably 130° C. or higher and 180° C. or lower In the pulverization step S4, the toner mixture is cooled and solidified, and the solidified product is pulverized by a mechanical pulverizer or fluidized bed (counter jet type) pulverizer. Thus, a pulverized product of a resin composition is obtained. The pulverized product of a resin composition is then classified to obtain a toner free of external additives.

In the external addition step S5, a toner free of external additives, and the external additives are mixed by an airflow mixing machine such as Henschel mixer, Supermixer, Mechanomill and Q-type mixer. Thus, a toner of the embodiment can be obtained.

The toner of the embodiment thus obtained is used in order to form an image on a sheet such as a copying paper by an image forming apparatus such as a copying apparatus and a printer apparatus.

In the image forming apparatus using the toner of the embodiment, an image is formed on a sheet as follows.

A photoreceptor drum is uniformly charged. Light image based on an image to be formed on the charged photoreceptor drum is scanned to form an electrostatic latent image. The toner of the invention is attached to the electrostatic latent image formed, thereby conducting development to form a visible image. The visible image obtained is transferred to a sheet. The toner transferred is fixed to the sheet, thereby forming an image.

EXAMPLES (Volume Average Particle Size of Toner)

The volume average particle size of a toner was measured by Coulter Multisizer II (manufactured by Coulter) using 100-μm aperture.

(Weight Average Molecular Weight (Mw) of Vinyl Resin)

The weight average molecular weight in terms of polystyrene of a sample was obtained by gel permeation chromatography (GPC). An apparatus used and use conditions are as follows. A calibration curve of a molecular weight was prepared using standard polystyrene.

Apparatus: SYSTEM-11 (trade name, manufactured by Showa Denko K.K.)

Column: TSKgel αMXL (trade name, manufactured by Tosoh Corporation), three columns Measurement temperature: 40° C.

Sample solution: 0.10% tetrahydrofuran solution of a sample

Injected amount: 100 mL

Detector: Refractive index detector (Softening Temperature of Vinyl Resin)

The softening temperature of a vinyl resin was measured using a KOKA-type flow tester (trade name: CET-500D, manufactured by Shimadzu Corporation). A sample was heated at a temperature rising rate of 6° C./minute while applying a load of 1.96 MPa in a plunger such that 1 g of the sample was extruded from a nozzle having a diameter of 1 mm and a length of 1 mm, and a plunger descent amount (flow amount)-temperature curve of a flow tester was obtained. When the height of the S-curve obtained is "h", the temperature corresponding to a half of h (h/2) is obtained as a temperature when half of the sample has flown out of the nozzle, and this temperature was considered as a softening temperature.

(Acid Values of Rosin and Unsaturated Fatty Acid)

In tetrahydrofuran, 1 g of a sample was dissolved, and potentiometric titration was conducted by an automatic titration apparatus (trade name: AT-510, manufactured by Kyoto Electronics Manufacturing Co., Ltd.) using a 0.1 N (0.1 mol/L) potassium hydroxide (chemical formula: KOH) ethanol solution as a volumetric solution. In the potentiometric titration, the mg value of potassium hydroxide used for neutralization was converted into a solid content as an acid value, thereby calculating an acid value of a sample.

(Glass Transition Temperature of Release Agent)

1 g of a sample (carboxyl group-containing resin or water-soluble resin) was heated at a temperature rising rate of 10° C./minute according to JIS K 7121-1987 using a differential scanning calorimeter (trade name: DSC200, manufactured by Seiko Electronics Industrial Co., Ltd.) to obtain a DSC curve. The temperature of an intersection point between a straight line extending a base line at high temperature side of an exothermic peak corresponding to glass transition of the DSC curve obtained to low temperature side and a tangent line drawn at a point at which a gradient to a curve from a rising portion of a peak to the top becomes maximum was obtained as a glass transition temperature (Tg).

(Melting Point of Release Agent)

Using a differential scanning calorimeter (trade name: DSC200, manufactured by Seiko Instruments & Electronics Ltd.), the temperature of a sample (1 g) was increased from 20° C. to 150° C. at a temperature rising rate of 10° C./minute, and the sample was then rapidly cooled from 150° C. to 20° C. This operation was repeated two times, and a DSC curve was obtained. The temperature of the top of an endothermic peak corresponding to fusion of the DSC curve measured at the second operation was obtained as a melting point of a sample.

Toners of the examples of the invention and toners of comparative examples, prepared by changing various conditions are described below.

Graft Polymers 1 to 8 were prepared as follows.

[Graft Polymer 1]

First, 100 parts by weight of xylene were introduced into a 300-ml separable flask equipped with a stirring device, a thermometer, a nitrogen inlet and a cooling pipe. The flask was heated in a nitrogen atmosphere, and a monomer solution containing raw materials shown below was added dropwise to the separable flask over 3 hours while maintaining the temperature of an inner space of the separable flask at 110° C.

| | |
|---|---|
| Styrene | 48 parts by weight |
| Normal butyl acrylate | 12 parts by weight |
| Glycidyl methacrylate | 40 parts by weight |
| Initiator (trade name: V-601, manufactured by Wako Pure Chemical Industries, Ltd.) | 3 parts by weight |

Then, 0.1 part by weight of an initiator (trade name: V-601, manufactured by Wako Pure Chemical Industries, Ltd.) was added to the reaction liquid, and reaction was further conducted for 5 hours. Subsequently, 30.4 g of hydrogenated rosin having an acid value of 160 mgKOH/g (trade name: HYPALE, manufactured by Arakawa Chemical Industries, Ltd.), 12.8 g of oleic acid having an acid value of 202 mgKOH/g (trade name: EXTRA OLEIN, manufactured by NOF Corporation) and 0.5 g of dimethylbenzylamine (catalyst) were added to the separable flask, and reaction was conducted for 3 hours. After confirming that a residual acid value was 5 mgKOH/g or less, the temperature of the inner space of the separable flask was decreased to 80° C. The pressure in the separable flask was reduced to 150 mmHg (20.0 kPa) by a vacuum pump, and desolvation treatment was conducted for 2 hours. Thus, Graft Polymer 1 was obtained. Graft Polymer obtained had a number average molecular weight (Mn) of 4,900, a weight average molecular weight (Mw) of 9,900, a glass transition temperature of 61° C. and a softening temperature of 114° C.

[Graft Polymer 2]

First, 100 parts by weight of xylene were introduced into a 300-ml separable flask equipped with a stirring device, a thermometer, a nitrogen inlet and a cooling pipe. The flask was heated in a nitrogen atmosphere, and a monomer solution containing raw materials shown below was added dropwise to the separable flask over 3 hours while maintaining the temperature of an inner space of the separable flask at 85° C.

| | |
|---|---|
| Styrene | 47.5 parts by weight |
| Normal butyl acrylate | 12 parts by weight |
| Glycidyl methacrylate | 40 parts by weight |
| Divinylbenzene | 0.5 part by weight |
| Initiator (trade name: V-601, manufactured by Wako Pure Chemical Industries, Ltd.) | 1.5 parts by weight |

Then, 0.1 part by weight of an initiator (trade name: V-601, manufactured by Wako Pure Chemical Industries, Ltd.) was added to the reaction liquid, and reaction was further conducted for 5 hours. Subsequently, 29.5 g of disproportionated rosin having an acid value of 155 mgKOH/g (trade name: RONDIS R, manufactured by Arakawa Chemical Industries, Ltd.), 12.8 g of oleic acid having an acid value of 202 mgKOH/g (trade name: EXTRA OLEIN, manufactured by NOF Corporation) and 0.5 g of dimethylbenzylamine (catalyst) were added to the separable flask, and reaction was conducted for 3 hours. After confirming that a residual acid value was 5 mgKOH/g or less, the temperature of the inner space of the separable flask was decreased to 80° C. Then, the pressure in the separable flask was reduced to 150 mmHg (20.0 kPa) by a vacuum pump, and desolvation treatment was conducted for 3 hours. Thus, Graft Polymer 2 was obtained. Graft Polymer 2 obtained had a number average molecular weight (Mn) of 10,900, a weight average molecular weight (Mw) of 78,700, a glass transition temperature of 63° C. and a softening temperature of 137° C.

[Graft Polymer 3]

First, 100 parts by weight of xylene were introduced into a 300-ml separable flask equipped with a stirring device, a thermometer, a nitrogen inlet and a cooling pipe. The flask was heated in a nitrogen atmosphere, and a monomer solution containing raw materials shown below was added dropwise to the separable flask over 3 hours while maintaining the temperature of an inner space of the separable flask at 85° C.

| | |
|---|---|
| Styrene | 44.5 parts by weight |
| Normal butyl acrylate | 15 parts by weight |
| 2-Hydroxyethyl methacrylate | 40 parts by weight |
| Vinylbenzene | 0.5 part by weight |
| Initiator (trade name: V-601, manufactured by Wako Pure Chemical Industries, Ltd.) | 1.5 parts by weight |

Then, 0.1 part by weight of an initiator (trade name: V-601, manufactured by Wako Pure Chemical industries, Ltd.) was added to the reaction liquid, and reaction was further conducted for 5 hours. The pressure in the separable flask was reduced to 150 mmHg (20.0 kPa) by a vacuum pump, and desolvation treatment was conducted for 1 hour. Subsequently, 32.2 g of disproportionated rosin having an acid value of 155 mgKOH/g (trade name: RONDIS R, manufactured by Arakawa Chemical Industries, Ltd.), 14.0 g of oleic acid having an acid value of 202 mgKOH/g (trade name: EXTRA OLEIN, manufactured by NOF Corporation) and 0.5 g of dibutyltin oxide (catalyst) were added to the separable flask, and reaction was conducted at 165° C. for 5 hours. After confirming that a residual acid value was 5 mgKOH/g or less, the temperature of the inner space of the separable flask was decreased to 80° C. The pressure in the separable flask was reduced to 150 mmHg (20.0 kPa) by a vacuum pump, and desolvation treatment was conducted for 3 hours. Thus, Graft Polymer 3 was obtained. Graft Polymer 3 obtained had a number average molecular weight (Mn) of 12,800, a weight average molecular weight (Mw) of 86,700, a glass transition temperature of 60° C. and a softening temperature of 138° C.

[Graft Polymer 4]

First, 100 parts by weight of xylene were introduced into a 300 ml separable flask equipped with a stirring device, a thermometer, a nitrogen inlet and a cooling pipe. The flask was heated in a nitrogen atmosphere, and a monomer solution containing raw materials shown below was added dropwise to the separable flask over 3 hours while maintaining the temperature of an inner space of the separable flask at 85° C.

| | |
|---|---|
| Styrene | 48 parts by weight |
| Normal butyl acrylate | 12 parts by weight |
| Glycidyl methacrylate | 40 parts by weight |
| Initiator (trade name: V-601, manufactured by Wako Pure Chemical Industries, Ltd.) | 1.5 parts by weight |

Then, 0.1 part by weight of an initiator (trade name: V-601, manufactured by Wako Pure Chemical Industries, Ltd.) was added to the reaction liquid, and reaction was further conducted for 5 hours. Subsequently, 26.2 g of disproportionated rosin having an acid value of 155 mgKOH/g (trade name: RONDIS R, manufactured by Arakawa Chemical Industries, Ltd.), 11.4 g of oleic acid having an acid value of 202 mgKOH/g (trade name: EXTRA OLEIN, manufactured by NOP Corporation) and 0.5 g of dimethylbenzylamine (catalyst) were added to the separable flask, and reaction was conducted for 3 hours. After confirming that a residual acid value was 5 mgKOH/g or less, the temperature of the inner space of the separable flask was decreased to 80° C. Then, the pressure in the separable flask was reduced to 150 mmHg (20.0 kPa) by a vacuum pump, and desolvation treatment was conducted for 3 hours. Thus, Graft Polymer 4 was obtained. Graft Polymer 4 obtained had a number average molecular weight (Mn) of 8,900, a weight average molecular weight (Mw) of 35,200, a glass transition temperature of 60° C. and a softening temperature of 125° C. Graft Polymer 4 had an epoxy equivalent of 1,570, and unreacted epoxy groups remained.

[Graft Polymer 5]

Graft Polymer 5 was obtained in the same manner as the preparation method of Graft Polymer 1, except that oleic acid was not added. Graft Polymer 5 obtained had a number average molecular weight (Mn) of 4,500, a weight average molecular weight (Mw) of 9,600, a glass transition temperature of 67° C. and a softening temperature of 121° C.

[Graft Polymer 6]

Graft Polymer 6 was obtained in the same manner as the preparation method of Graft Polymer 2, except that oleic acid was not added. Graft Polymer 6 obtained had a number average molecular weight (Mn) of 9,300, a weight average molecular weight (Mw) of 69,900, a glass transition temperature of 71° C. and a softening temperature of 142° C.

[Graft Polymer 7]

Graft Polymer 7 was obtained in the same manner as the preparation method of Graft Polymer 1, except that hydrogenated rosin was not added. Graft Polymer 7 obtained had a number average molecular weight (Mn) of 4,700, a weight average molecular weight (Mw) of 9,800, a glass transition temperature of 56° C. and a softening temperature of 103° C.

[Graft Polymer 8]

Graft Polymer 8 was obtained in the same manner as the preparation method of Graft Polymer 2, except that disproportionated rosin was not added. Graft Polymer 8 obtained had a number average molecular weight (Mn) of 9,200, a weight average molecular weight (Mw) of 73,500, a glass transition temperature of 57° C. and a softening temperature of 107° C.

Functional groups present in the monomer unit of the vinyl resin and the kinds of the rosin and the fatty acid are shown in Table 1 below.

TABLE 1

| | Kind of functional group | Kind of rosin | Kind of unsaturated fatty acid |
|---|---|---|---|
| Graft Polymer 1 | Epoxy group | Hydrogenated rosin | Oleic acid |
| Graft Polymer 2 | Epoxy group | Disproportionated rosin | Oleic acid |
| Graft Polymer 3 | Hydroxyl group | Disproportionated rosin | Oleic acid |
| Graft Polymer 4 | Epoxy group | Disproportionated rosin | Oleic acid |
| Graft Polymer 5 | Epoxy group | Hydrogenated rosin | — |
| Graft Polymer 6 | Epoxy group | Disproportionated rosin | — |
| Graft Polymer 7 | Epoxy group | — | Oleic acid |
| Graft Polymer 8 | Epoxy group | — | Oleic acid |

Masterbatch was prepared as follows.

[Masterbatch 1]

| | |
|---|---|
| Graft Polymer 1 | 70 parts by weight |
| Quinacridone pigment (trade name: Pigment Red 3090, manufactured by Sanyo Color Works, Ltd.) | 30 parts by weight |

First, 10 kg of the above raw materials were mixed by HENSCHEL MIXER under the conditions of a blade rotation number of 700 rpm and a treatment time of 3 minutes. The masterbatch mixture obtained was quantitatively fed to a continuous two-roll kneading machine (open roll kneading machine, manufactured by Mitsui Mining Co., Ltd.) by a table feeder, and kneaded. The masterbatch kneaded material obtained was cooled and coarsely pulverized by a hammer type pulverizer using a 2-m/m screen. Thus, Masterbatch 1 was obtained.

[Masterbatch 2]

Masterbatch 2 was obtained in the same manner as the preparation method of Masterbatch 1, except for using Graft Polymer 5 in place of Graft Polymer 1.

[Masterbatch 3]

Masterbatch 3 was obtained in the same manner as the preparation method of Masterbatch 1, except for using Graft Polymer 7 in place of Graft Polymer 1.

Example 1

| | |
|---|---|
| Graft Polymer 2 | 73 parts by weight |
| Masterbatch 1 | 15 parts by weight |
| Polyethylene wax (trade name: PW-600, manufactured by Baker Petrolite, melting point: 87° C.) | 10 parts by weight |
| Boron complex (trade name: LR-147, manufactured by Clariant) | 2 parts by weight |

First, 10 kg of raw materials having the above formulations were weighed and mixed by HENSCHEL MIXER under the conditions of a blade rotation number of 850 rpm and a treatment time of 2 minutes. Thus, a toner mixture was obtained.

The toner mixture obtained was kneaded using an extruder (trade name: PCM-30, manufactured by Ikegai) as a kneading machine at a cylinder preset temperature of 120° C., a barrel rotation number of 300 rpm and a raw material feed rate of 20 kg/hour. The toner kneaded material obtained was cooled with a cooling belt, and then coarsely pulverized by a speed mill having a screen of 2 mm in diameter. The toner coarsely pulverized material was pulverized by I-type jet mill. Fine particles and coarse particles were removed by an elbow jet classifier.

Thus, a toner free of external additives, adjusted to nearly normal distribution in which variation coefficient is about 25 was obtained.

Then, 1.2 parts by weight of a hydrophobic silica powder (BET specific surface area: 140 $m^2/g$) surface-treated with a silane coupling agent and a dimethyl silicone oil, 0.8 part by weight of a hydrophobic silica powder (BET specific surface area: 30 $m^2/g$) surface-treated with a silane coupling agent, and 0.5 part by weight of titanium oxide (BET specific surface area: 130 $m^2/g$) were mixed with 100 parts by weight of the toner free of external additives obtained. Thus, a negative triboelectric charge type toner of Example 1 was obtained.

Examples 2 to 4

Negative triboelectric charge type toners of Examples 2 to 4 were obtained in the same manner as in Example 1, except that polyethylene waxes having melting points shown in Table 2 were used in place of the polyethylene wax used in Example 1.

Example 5

Negative triboelectric charge type toner of Example 5 was obtained in the same manner as in Example 1, except that Graft Polymer 3 was used in place of Graft Polymer 2.

Example 6

Negative triboelectric charge type toner of Example 6 was obtained in the same manner as in Example 1, except that toner raw materials shown below were used in place of the toner raw materials used in Example 1, and the temperature at the time of kneading was changed to 150° C. In Example 6, intermolecular crosslinking of the graft polymer is conducted at the time of kneading of the toner mixture.

| | |
|---|---|
| Graft Polymer 4 | 74 parts by weight |
| Trimellitic anhydride | 4 parts by weight |
| Masterbatch 1 | 15 parts by weight |
| Polyethylene wax (trade name: PW-600, manufactured by Baker Petrolite, melting point: 87° C.) | 5 parts by weight |
| Boron complex (trade name: LR-147, manufactured by Clariant) | 2 parts by weight |

Example 7

Negative triboelectric charge type toner of Example 7 was obtained in the same manner as in Example 6, except that trimellitic anhydride was not added.

Example 8

Negative triboelectric charge type toner of Example 8 was obtained in the same manner as in Example 1, except that an ester wax (trade name: WEP-5, manufacture by NOF Corporation, melting point: 83° C.) was used in place of the polyethylene wax, as the release agent.

Comparative Example 1

Negative triboelectric charge type toner of Comparative Example 1 was obtained in the same manner as in Example 1, except that Masterbatch 2 was used in place of Masterbatch 1, and Graft Polymer 6 was used in place of Graft Polymer 2.

Comparative Example 2

Negative triboelectric charge type toner of Comparative Example 2 was obtained in the same manner as in Example 1, except that Masterbatch 3 was used in place of Masterbatch 1, and Graft Polymer 8 was used in place of Graft Polymer 2.

Kinds of graft polymers, kinds of masterbatches and melting points of release agents, in Examples 1 to 8 and Comparative Examples 1 and 2 are shown in Table 2 below.

TABLE 2

| | Kind of graft polymer | Kind of masterbatch | Kind of release agent | Melting point of release agent (° C.) |
|---|---|---|---|---|
| Example 1 | Graft Polymer 2 | Masterbatch 1 | Polyethylene wax | 87 |
| Example 2 | Graft Polymer 2 | Masterbatch 1 | Polyethylene wax | 76 |
| Example 3 | Graft Polymer 2 | Masterbatch 1 | Polyethylene wax | 105 |
| Example 4 | Graft Polymer 2 | Masterbatch 1 | Polyethylene wax | 114 |
| Example 5 | Graft Polymer 3 | Masterbatch 1 | Polyethylene wax | 87 |
| Example 6 | Graft Polymer 4 | Masterbatch 1 | Polyethylene wax | 87 |
| Example 7 | Graft Polymer 4 | Masterbatch 1 | Polyethylene wax | 87 |
| Example 8 | Graft Polymer 2 | Masterbatch 1 | Ester wax | 83 |
| Comparative Example 1 | Graft Polymer 6 | Masterbatch 2 | Polyethylene wax | 87 |
| Comparative Example 2 | Graft Polymer 8 | Masterbatch 3 | Polyethylene wax | 87 |

The following evaluations were conducted using the toners of Examples 1 to 8 and Comparative Examples 1 and 2.

(Color Reproducibility)

A copying machine (MX-450) manufactured by Sharp Corporation was used. The copying machine was adjusted such that the attachment amount of a toner is 0.45 mg/cm$^2$, and an unfixed image was formed on an A4-size full-color dedicated paper (trade name: PP106A4C, manufactured by Sharp Corporation). The unfixed image formed was fixed at 165° C. by an oilless fixing system external fixing machine. The processing speed of the fixing machine was 220 mm/sec.

The chromaticness indexes, a* and b* values, of the image obtained above in L*a*b* color system (CIE 1976) (CIE: Commission Internationaledel' Eclairage) were obtained by a spectrophotometer (trade name: X-Rite, manufactured by Nihon Heihan Insatsu Kizai K.K.), and chroma C* was calculated based on the following formula (1). The chroma C* was used as an index of color reproducibility, and the case that the chroma C* is 80 or more was evaluated as "Good", the case that the chroma C* is 75 or more and is less than 80 was evaluated as "Not bad", the case that the chroma C* is 75 or less was evaluated as "Poor", and the case that the chroma C* is 75 or more was considered as being at a level causing no problem for practical use.

$$C^*=(a^*\times 2+b^*\times 2)\times(1/2) \quad (1)$$

(Low Temperature Fixability)

An unfixed image was formed in the same manner as in the above evaluation method of color reproducibility. Fixing was conducted at a given temperature by an oilless fixing system external fixing machine, and the presence or absence of offset to a paper surface was visually evaluated. Paper of 52 g/m$^2$ was used as an A4-size test paper.

The case that the lower limit temperature of fixing is 140° C. or lower was evaluated as "Good", the case that the lower limit temperature of fixing exceeds 140° C. and is lower than 160° C. was evaluated as "Not bad", and the case that the lower limit temperature of fixing is 160° C. or higher was evaluated as "Poor". The case that the lower limit temperature of fixing is lower than 160° C. was considered as being at a level causing no problem for practical use.

(Offset Resistance)

The upper limit temperature of fixing was obtained in the same manner as in the evaluation method of the low temperature fixability, and a difference between the upper limit temperature of fixing and the lower limit temperature of fixing was considered as a fixing non-offset range. The case that the fixing non-offset range is 60° C. or more was evaluated as "Good", the case that the fixing non-offset range exceeds 40° C. and is less than 60° C. was evaluated as "Not bad", and the case that the fixing non-offset range is 40° C. or less was evaluated as "Poor".

The case that the fixing non-offset range exceeds 40° C. was considered as being at a level causing no problem for practical use.

(Toner Durability)

A developer having the ratio between each of the toners of the examples and the comparative examples and a carrier is 10:90 was placed in a developing tank of the copying machine, and the weight of the developer discharged from the developing tank was measured. The developer was subjected to idle running for 2 hours under an environment of a temperature of 53° C., and the weight of the developer discharged from the developing tank after passing a certain time was then measured. The weight was compared with the weight of the developer discharged before idle running. Thus, the discharge rate of the developer was obtained. The higher discharge rate indicates that aggregation of the toner at high temperature can be prevented, resulting in excellent toner durability.

The discharge rate is obtained from the following formula (2).

$$\text{Discharge rate (\%)}=\{(\text{Weight of developer discharged after idle running})/(\text{Weight of developer discharged before idle running})\}\times 100 \quad (2)$$

The case that the discharge rate is 70% or more is evaluated as "Good", the case that the discharge rate exceeds 50% and is less than 70% is evaluated as "Not bad", and the case that the discharge rate is 50% or less is evaluated as "Poor". The case that the discharge rate exceeds 50% is considered as being at a level causing no problem for practical use.

(Comprehensive Evaluation)

Comprehensive evaluation was made using the above evaluation results.

Evaluation standards of the comprehensive evaluation are as follows.

Excellent: The evaluation results are all "Good".

Good: The evaluation results contain "Not bad", but do not contain "Poor".

Poor: The evaluation results contain "Poor".

The evaluation results and comprehensive evaluations are shown in Table 3.

TABLE 3

| | Color reproducibility | | Low temperature fixability | | Offset resistance | | Toner durability | | Comprehensive |
|---|---|---|---|---|---|---|---|---|---|
| | Chroma C* | Evaluation | Lower limit temperature of fixing | Evaluation | Fixing non-offset range (° C.) | Evaluation | Discharge rate (%) | Evaluation | evaluation |
| Example 1 | 81 | Good | 135 | Good | 60 | Good | 75 | Good | Excellent |
| Example 2 | 81 | Good | 130 | Good | 60 | Good | 61 | Not bad | Good |
| Example 3 | 80 | Good | 140 | Good | 60 | Good | 82 | Good | Excellent |
| Example 4 | 80 | Good | 150 | Not bad | 60 | Good | 89 | Good | Good |
| Example 5 | 81 | Good | 135 | Good | 60 | Good | 73 | Good | Excellent |
| Example 6 | 83 | Good | 135 | Good | 65 | Good | 82 | Good | Excellent |
| Example 7 | 84 | Good | 135 | Good | 50 | Not bad | 75 | Good | Good |
| Example 8 | 82 | Good | 135 | Good | 45 | Not bad | 73 | Good | Good |
| Comparative Example 1 | 73 | Poor | 155 | Not bad | 60 | Good | 29 | Poor | Poor |
| Comparative Example 2 | 65 | Poor | 130 | Good | 60 | Good | 57 | Not bad | Poor |

As shown in Table 3, color reproducibility, low temperature fixability, offset resistance and toner durability were good in Examples 1 to 8.

However, in Example 2, because the melting point of the release agent is lower than the melting points of the release agents of other examples, the toner durability was slightly decreased.

In Example 4, because the melting point of the release agent is higher than the melting points of the release agents of other examples, the low temperature fixability was slightly decreased.

In Example 6, because the graft polymer was intermolecularly crosslinked, the offset resistance was improved as compared with that of Example 7.

In Example 8, because a release agent other than the synthetic hydrocarbon wax was used as the release agent, the offset resistance was slightly decreased.

In Comparative Example 1, because the graft polymer in which an unsaturated fatty acid is not grafted was used, dispersibility of the release agent was decreased and toner durability was decreased. Furthermore, color reproducibility was decreased.

In Comparative Example 2, because the graft polymer in which abietic acids are not grafted was used, dispersibility of the pigment was decreased and color reproducibility was decreased. Furthermore, toner durability was decreased.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A toner comprising a binder resin, a pigment and a release agent, the binder resin comprising a graft polymer in which abietic acids and an unsaturated fatty acid are grafted to a vinyl resin.

2. The toner of claim 1, wherein the vinyl resin comprises a monomer unit comprising an acrylate monomer having a glycidyl group.

3. The toner of claim 1, wherein the abietic acids are abietic acids contained in a purified rosin, a hydrogenated rosin or a disproportionated rosin.

4. The toner of claim 1, wherein the graft polymer is intermolecularly crosslinked.

5. The toner of claim 1, wherein the release agent is a synthetic hydrocarbon wax.

6. The toner of claim 1, wherein the release agent has a melting point of 80° C. or higher and 110° C. or lower.

* * * * *